US005847377A

United States Patent [19]

Yang et al.

[11] Patent Number: 5,847,377

[45] Date of Patent: Dec. 8, 1998

[54] MICROWAVE OVEN PROVIDED WITH AN IMPROVED COOLING SYSTEM

[75] Inventors: Kyung-Hoi Yang; Myeong-Ho Yoon; Won-Ki Nam; Byeong-Woo Yi; Mun-Young Choi, all of Incheon, Rep. of Korea

[73] Assignee: Daewoo Electronics Co., Ltd., Rep. of Korea

[21] Appl. No.: 868,928

[22] Filed: Jun. 4, 1997

[51] Int. Cl.[6] ..... H05B 6/64

[52] U.S. Cl. ..... 219/757; 126/21 A

[58] Field of Search ..... 219/757, 681; 126/21 R, 21 A, 198

[56] References Cited

U.S. PATENT DOCUMENTS

| | | | |
|---|---|---|---|
| 4,184,945 | 1/1980 | Morgan et al. | 219/757 |
| 4,812,617 | 3/1989 | Takeuji et al. | 219/757 |
| 4,966,524 | 10/1990 | Kodama et al. | 219/757 |

FOREIGN PATENT DOCUMENTS

| | | | |
|---|---|---|---|
| 1-28422 | 1/1989 | Japan | 219/757 |
| 2-244586 | 9/1990 | Japan | 219/757 |
| 5-52344 | 3/1993 | Japan | 219/757 |

*Primary Examiner*—Philip H. Leung
*Attorney, Agent, or Firm*—Pennie & Edmonds LLP

[57] ABSTRACT

A microwave oven incorporating therein an air cooling system comprises an outer casing containing a cooking chamber and a compartment. The compartment is provided with an air intake opening. A magnetron and a high voltage transformer are positioned at upper and lower sides within the compartment, respectively. A cooling fan is disposed at a position near the high voltage transformer and forces cooling air around the microwave oven to enter the compartment through the air intake opening and to leave the compartment along a plurality of airflow routes. A screen plate is disposed between the high voltage transformer and the cooling fan and directs a part of the cooling air from the cooling fan to the magnetron so that the magnetron is directly cooled by the cooling air.

11 Claims, 4 Drawing Sheets

MICROWAVE OVEN PROVIDED WITH AN IMPROVED COOLING SYSTEM

FIELD OF THE INVENTION

The present invention relates to a microwave oven; and, more particularly, to a microwave oven provided with an improved cooling system in which a magnetron is directly cooled by a part of the cooling air from a cooling fan.

DESCRIPTION OF THE PRIOR ART

A microwave oven normally has a cooling system for cooling electric parts incorporated therein. There are shown in FIG. 1 a conventional cooling system disclosed in the U.S. Pat. No. 4,786,774 in which a cooling fan 10 is so disposed that the cooling air from an air intake 11 is directly blown onto a high voltage transformer 12 and, in turn, onto a magnetron 13.

On the other hand, there is shown in FIG. 2 another conventional cooling system disclosed in the U.S. Pat. No. 4,327,274. A cooling fan 64 is disposed between a high voltage transformer 62 and a housing 70 enclosing a magnetron so that the cooling air from an air intake (not shown) flows through the high voltage transformer 62 and, in turn, through the magnetron.

In such conventional cooling systems, the cooling air initially passes through the high voltage transformer, with the temperature thereof raised, and as a consequence, by the time it reaches the magnetron, its cooling effectiveness therefor is reduced.

SUMMARY OF THE INVENTION

It is, therefore, a primary object of the invention to provide a microwave oven provided with a cooling system wherein a magnetron is directly cooled by a part of the cooling air from a cooling fan.

In accordance with one aspect of the present invention, there is provided a microwave oven incorporating therein an air cooling system, which comprises: au outer casing containing a cooking chamber and a compartment, the compartment being provided with an air intake opening; a magnetron and a high voltage transformer positioned at upper and lower sides within the compartment, respectively; a cooling fan disposed at a position near the high voltage transformer, the cooling fan forcing cooling air around the microwave oven to enter the compartment through the air intake opening and to leave the compartment along a plurality of airflow routes; and a screen plate disposed between the high voltage transformer and the cooling fan, the screen plate directing a part of the cooling air from the cooling fan to the magnetron so that the magnetron is directly cooled by the cooling air.

BRIEF DESCRIPTION OF THE DRAWINGS

The above and other objects and features of the present invention will become apparent from the following description of preferred embodiments taken in conjunction with the accompanying drawings, in which.

DETAILED DESCRIPTION OF THE PREFERRED EMBODIMENT

Figure 1:
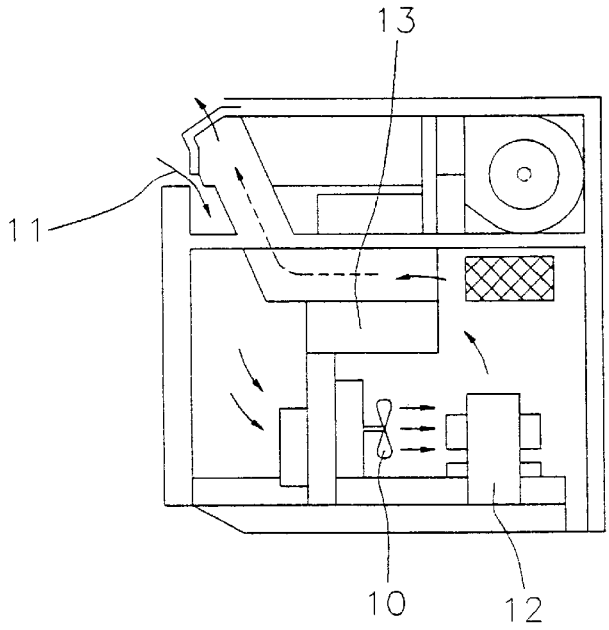
FIG. 1 (PRIOR ART)
FIG. 1 shows a schematic sectional view of a microwave oven incorporating therein a conventional cooling system.
Figure 2:
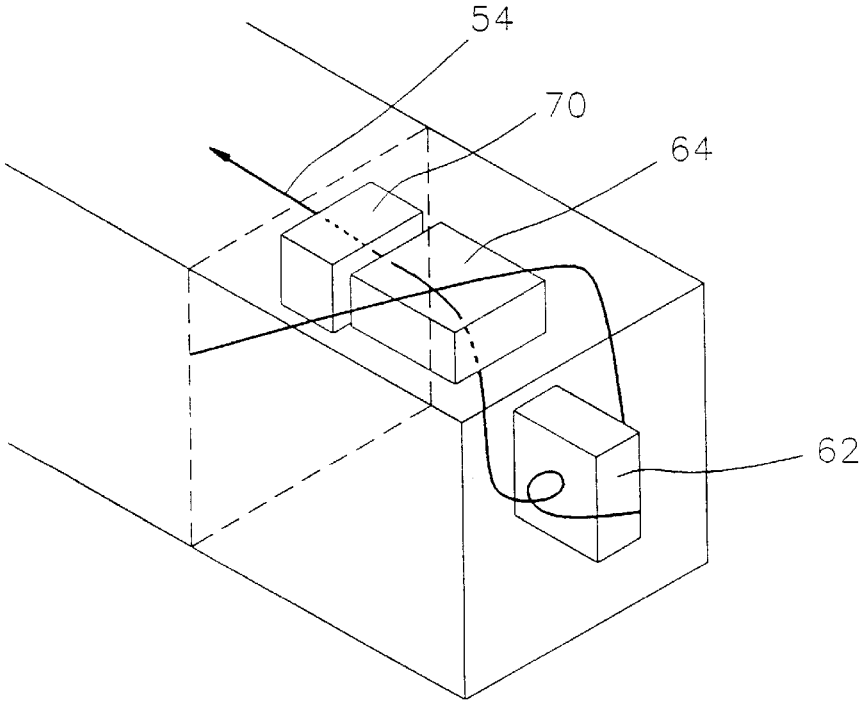
FIG. 2 (PRIOR ART)
FIG. 2 depicts a schematic perspective view of a microwave oven incorporating therein another conventional cooling system.
Figure 3:
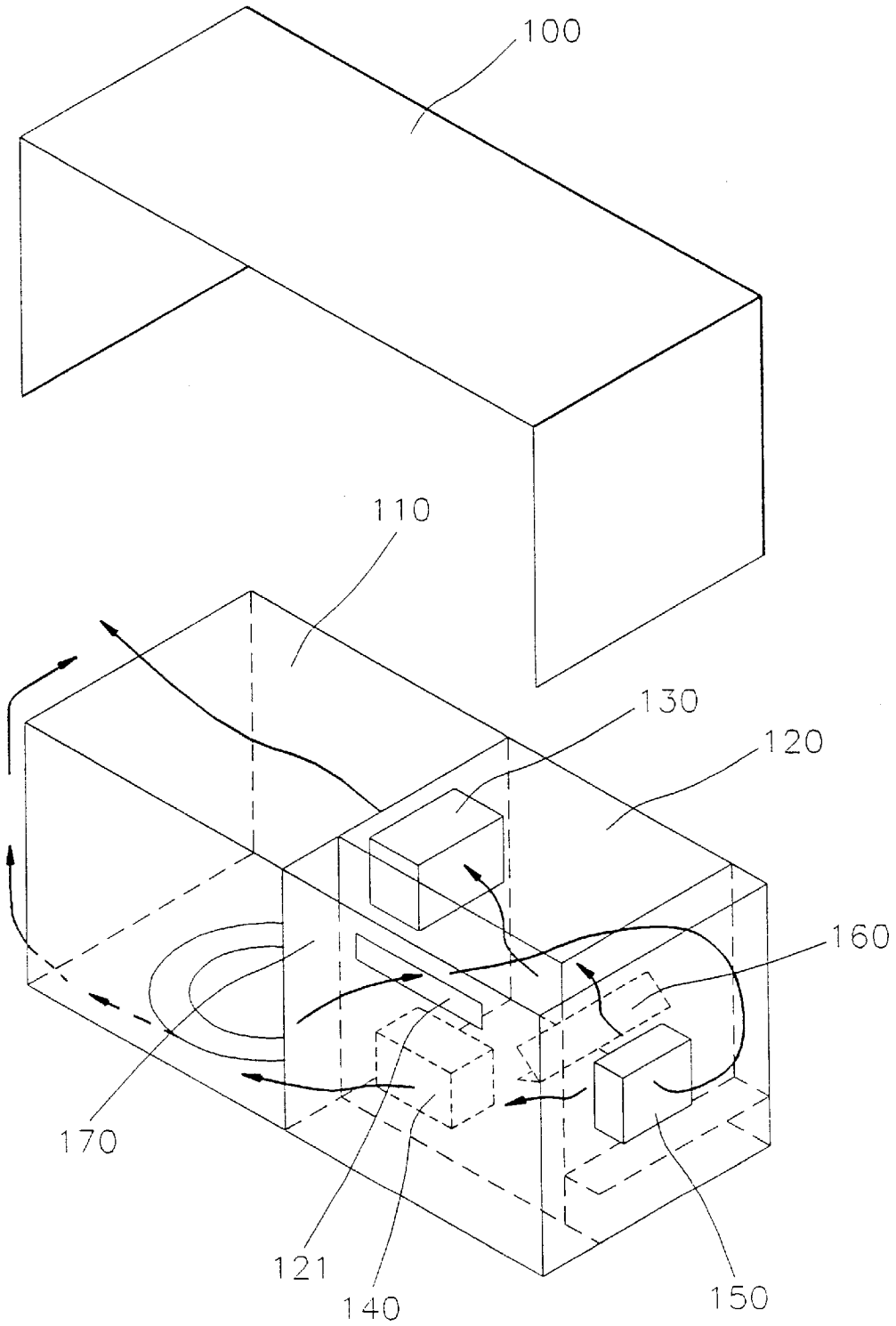
FIG. 3 illustrates a schematic exploded perspective view of a microwave oven incorporating therein a cooling system in accordance with the present invention.
Figure 4:
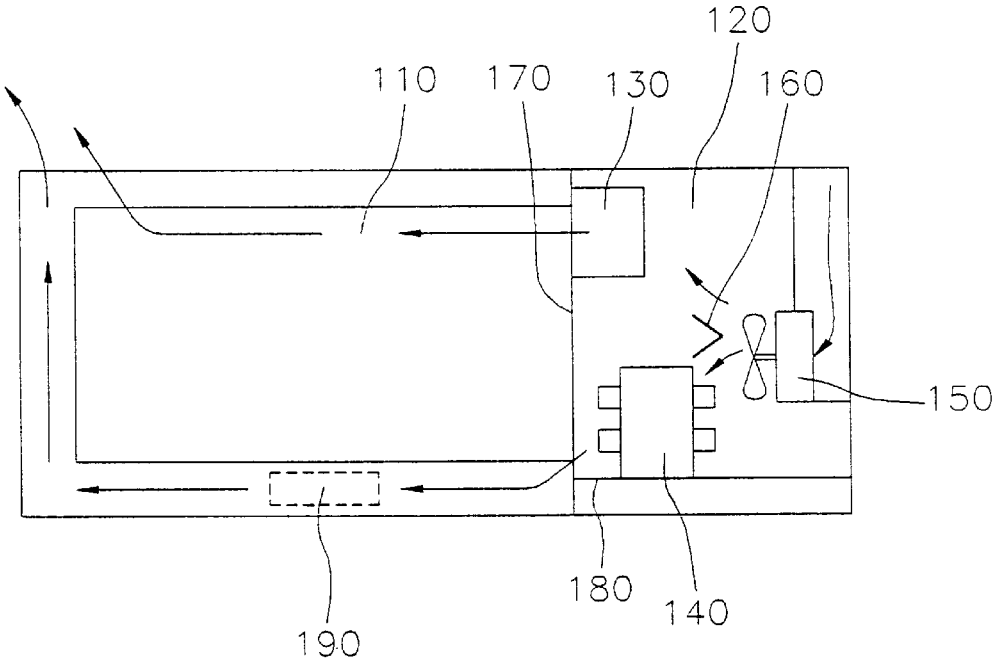
FIG. 4 represents a schematic front view of the microwave oven in FIG. 3.

Referring to FIGS. 3 and 4, a microwave oven incorporating therein a cooling system of the present invention comprises an outer casing 100 containing a cooking chamber 110 and a compartment 120. A magnetron 130 and a high voltage transformer 140 are positioned at upper and lower sides within the compartment 120, respectively. A cooling fan 150 is disposed at a position near the high voltage transformer 140 and forces cooling air around the microwave oven to enter the compartment 120 through the air intake opening 121 and to leave the compartment along a plurality of airflow routes. A wedge-shaped screen plate 160 is disposed between the cooling fan 150 and the high voltage transformer 140. The screen plate 160 directs a part of the cooling air from the cooling fan 150 to the magnetron 130 so that the magnetron 130 is directly cooled by the cooling air. The air passing through the magnetron 130 enters the cooking chamber 110 through apertures (not shown) formed on a partition wall 170 between the cooking chamber 110 and the compartment 120, which forms a first airflow route. Air flowing along the first airflow route removes the moisture in the cooling chamber 110.

On the other hand, the other part of the cooling air from the cooling fan passes through the high voltage transformer 140 and, in turn, between the floor of the cooking chamber 110 and a base panel 180 to cool a turntable driving motor 190, which forms a second airflow route.

Figure 5:
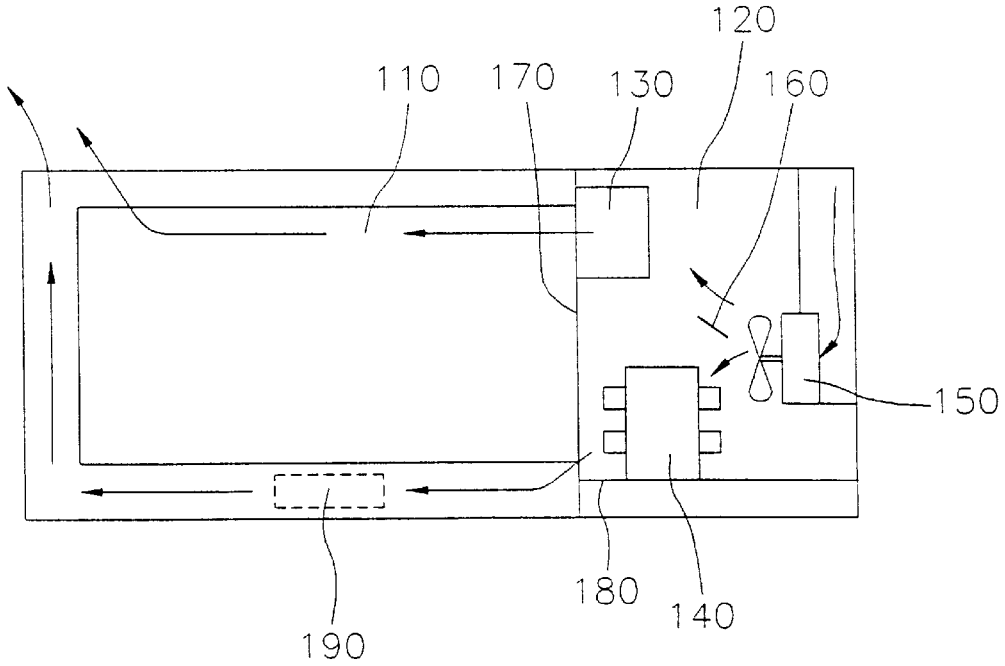
FIGS. 5 and 6 present schematic front views of various embodiments of the microwave oven in FIG. 3.
Figure 6:
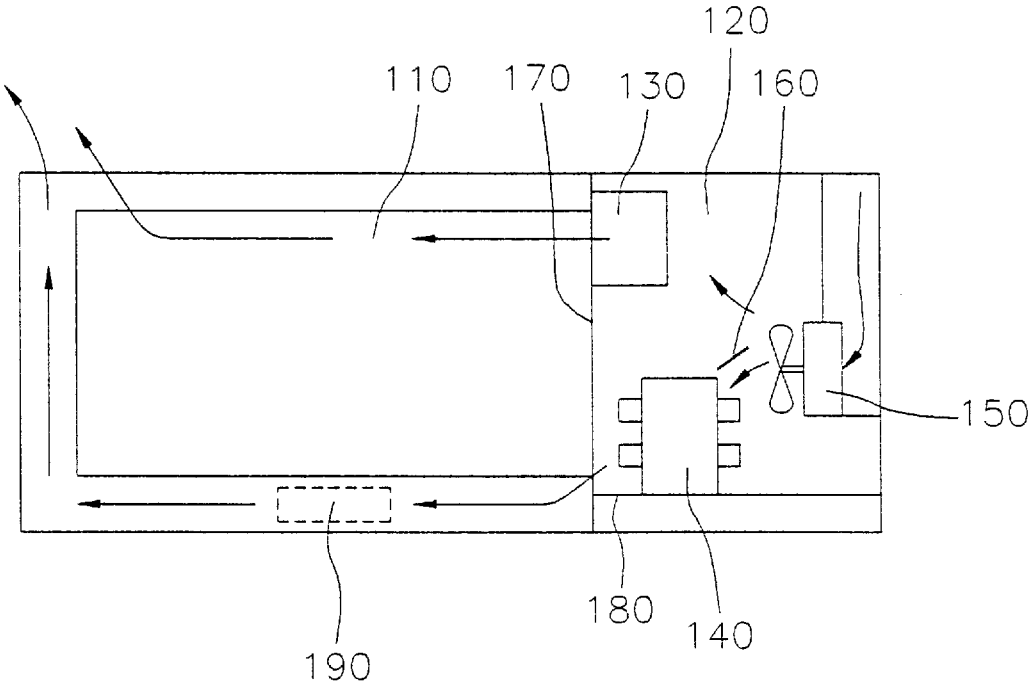

The screen plate 160 may be a flat plate slanted with respect to the horizontal plane toward the high voltage transformer 140 or the magnetron 130, as shown in FIGS. 5 and 6.

According to the present invention, unlike in the prior art cooling systems, the magnetron is directly exposed to and cooled by the cooling air from the cooling fan so that the cooling effectiveness therefor is increased.

Although the invention has been shown and described with respect to the preferred embodiments, it will be understood by those skilled in the art that various changes and modifications may be made without departing from the spirit and scope of the invention as defined in the following claims.

What is claimed is:

1. A microwave oven incorporating therein an air cooling system, which comprises:

an outer casing containing a cooking chamber and a compartment;

a magnetron and a high voltage transformer positioned at upper and lower sides within the compartment, respectively;

a cooling fan disposed at a position near the high voltage transformer, the cooling fan forcing cooling air around the microwave oven to enter the compartment through an air intake opening and to leave the compartment along a plurality of airflow routes; and a screen plate disposed between the high voltage transformer and the cooling fan, the screen plate directing a part of the cooling air from the cooling fan to the magnetron and the other part thereof to the high voltage transformer so that the magnetron and the high voltage transformer are directly cooled by the cooling air.

2. The microwave oven of claim 1, wherein the screen plate is of a wedge shape.

3. The microwave oven of claim 1, wherein the screen plate is a flat plate and is disposed to be slanted with respect to a horizontal plane.

4. The microwave oven of claim 3, wherein the screen plate is disposed to be slanted toward the high voltage transformer.

5. The microwave oven of claim 3, wherein the screen plate is disposed to be slanted toward the magnetron.

6. A microwave oven incorporating therein an air cooling system, which comprises:

an outer casing containing a cooking chamber and a compartment;

a magnetron and a high voltage transformer positioned within the compartment;

a cooling fan disposed within the compartment, the cooling fan forcing cooling air around the microwave oven to enter the compartment through an air intake opening and to leave the compartment along a first and second airflow route; and a screen plate disposed between the high voltage transformer and the cooling fan, the screen plate directing a part of the cooling air from the cooling fan to the magnetron which forms the first airflow route, and the other part of the cooling air from the cooling fan to the high voltage transformer which forms the second airflow route, so that the magnetron and the high voltage transformer are directly cooled by the cooling air.

7. The microwave oven of claim 6, wherein the magnetron is positioned at an upper side within the compartment, and the high voltage transformer is positioned at a lower side within the compartment.

8. The microwave oven of claim 7, wherein the compartment is provided with the air intake opening.

9. The microwave oven of claim 6, wherein the air flowing along the first airflow route enters the cooking chamber.

10. The microwave oven of claim 9, further including a partition wall between the cooking chamber and the compartment, the partition wall having apertures formed therethrough through which the air flowing along the first airflow route enters the cooking chamber.

11. The microwave oven of claim 9, further including a base panel, and the cooking chamber further includes a floor spaced from the base panel to receive a turntable driving motor therebetween, and the air flowing along the second airflow route enters between the floor and the base panel to cool the turntable driving motor.

* * * * *